US008698693B2

(12) United States Patent
Dresel et al.

(10) Patent No.: US 8,698,693 B2
(45) Date of Patent: Apr. 15, 2014

(54) COLLAPSIBLE ANTENNA

(75) Inventors: Jürgen Dresel, Sandton (ZA); Thomas David Abbott, Sandton (ZA)

(73) Assignee: Poynting Antennas (PTY) Limited, Sandton (ZA)

( * ) Notice: Subject to any disclaimer, the term of this patent is extended or adjusted under 35 U.S.C. 154(b) by 628 days.

(21) Appl. No.: 13/045,419

(22) Filed: Mar. 10, 2011

(65) Prior Publication Data

US 2011/0221646 A1 Sep. 15, 2011

(30) Foreign Application Priority Data

Mar. 10, 2010 (ZA) ..... 2010/01709

(51) Int. Cl.
*H01Q 1/08* (2006.01)
*H01Q 11/10* (2006.01)

(52) U.S. Cl.
USPC ..... 343/880; 343/792.5

(58) Field of Classification Search
USPC ..... 343/792.5, 880
See application file for complete search history.

(56) References Cited

U.S. PATENT DOCUMENTS 4,262,293 A * 4/1981 Parmer ..... 343/792.5
4,460,895 A * 7/1984 Bert et al. ..... 343/713
4,564,844 A * 1/1986 Bowering ..... 343/881

* cited by examiner

*Primary Examiner* — Robert Karacsony
(74) *Attorney, Agent, or Firm* — Fulwider Patton LLP

(57) ABSTRACT

A collapsible antenna (10) comprises an elongate boom (12) having a main axis (14) and a plurality of elongate radiating elements (16) having respective first ends (18.1) and respective second ends (18.2). At least some of the elongate radiating elements are flexible and are mounted at the respective first ends to the boom in longitudinally spaced relation. Regions towards the respective second ends of the at least some of the elongate radiating elements engage a flexible rope (20). The flexible rope forms part of a frame (22) which is manipulatable relative to the boom between a first collapsed configuration and a second operative configuration wherein the at least some radiating elements are in an operative configuration relative to the boom.

15 Claims, 7 Drawing Sheets

COLLAPSIBLE ANTENNA

INTRODUCTION AND BACKGROUND

This invention relates to antennas and more particularly to collapsible antennas.

Log periodic dipole array (LPDA) antennas are well known wideband antennas that are commonly used in communications, monitoring and electronic warfare applications. The antenna comprises a boom and a plurality of radiating elements that are arranged substantially coplanar with each other and at right angles to the boom. Currently, these antennas are transported in one of two forms—either as a fully assembled and operative antenna, or, in the form of a boom, which may comprise a plurality of sections, and a plurality of radiating elements which are supplied and transported separately and which are first attached to the boom, when the antenna is assembled. In the first form, the antenna often is too bulky and takes up too much space. In the second form, it takes up unnecessary time and requires skill to assemble the antenna.

OBJECT OF THE INVENTION

Accordingly, it is an object of the present invention to provide an alternative antenna with which the applicant believes the aforementioned disadvantages may at least be alleviated or which may provide a useful alternative for the known antennas.

SUMMARY OF THE INVENTION

According to the invention there is provided a collapsible antenna, the antenna comprising:

- an elongate boom having a main axis;
- a plurality of elongate radiating elements having respective first and second ends;
- at least some of the elongate radiating elements being flexible and being mounted at the respective first ends on the boom in longitudinally spaced relation;
- regions towards the respective second ends of the at least some of the elongate radiating elements directly or indirectly engaging a flexible rope; and
- the flexible rope forming part of a frame which is collapsible relative to the boom between a first collapsed configuration and a second operative configuration wherein the at least some radiating elements are in an operative configuration relative to the boom.

The flexible rope may be non-conductive. In some embodiments the rope may comprise a thin flexible kernmantle rope, which provides the necessary strength and does not collapse easily In the operative configuration, the at least some of the elongate radiating elements extend perpendicularly to the boom.

Each radiating element may comprise a multi-stranded soft stainless steel wire, which may be plated black, to reduce the visibility of the antenna.

The boom may extend between a base and a head and the frame may comprise at least one stiff pivotable arm adjacent the base. The arm may be conductive and serve as a radiating element, alternatively it may be made of an insulating material. In the case of the arm being conductive, the arm may comprise a thin-walled aluminium tube, which provides the necessary flexibility and strength to support the structure.

The frame may comprise at least one stiff arm adjacent the head. The arm may be pivotable relative to the boom or may be removable from the boom. The arm may be conductive and serve as a radiating element, alternatively it may be made of an insulating material.

Each of the respective first ends of the at least some of the elongate radiating elements may be permanently mounted on the boom by a mounting member. The mounting member may comprise an externally threaded sleeve which is crimped onto the respective first end.

Each of the at least some of the elongate radiating elements may comprise towards the respective second end thereof a ferrule defining an eye, the ferrule may be made of an insulating material and the rope may extend through the eye.

The boom may be a centre boom and the radiating elements may be mounted on either side of the boom. The antenna may be generally symmetrical. The antenna may be a log periodic dipole antenna (LPDA).

In other embodiments, the antenna may be asymmetrical. In one form, the radiating elements may be mounted on one side of the boom only.

According to another aspect of the invention, there is provided a kit comprising a collapsible antenna as herein defined and/or described and a portable container therefor.

BRIEF DESCRIPTION OF THE ACCOMPANYING DIAGRAMS

The invention will now further be described, by way of example only, with reference to the accompanying diagrams wherein.

Figure 1:
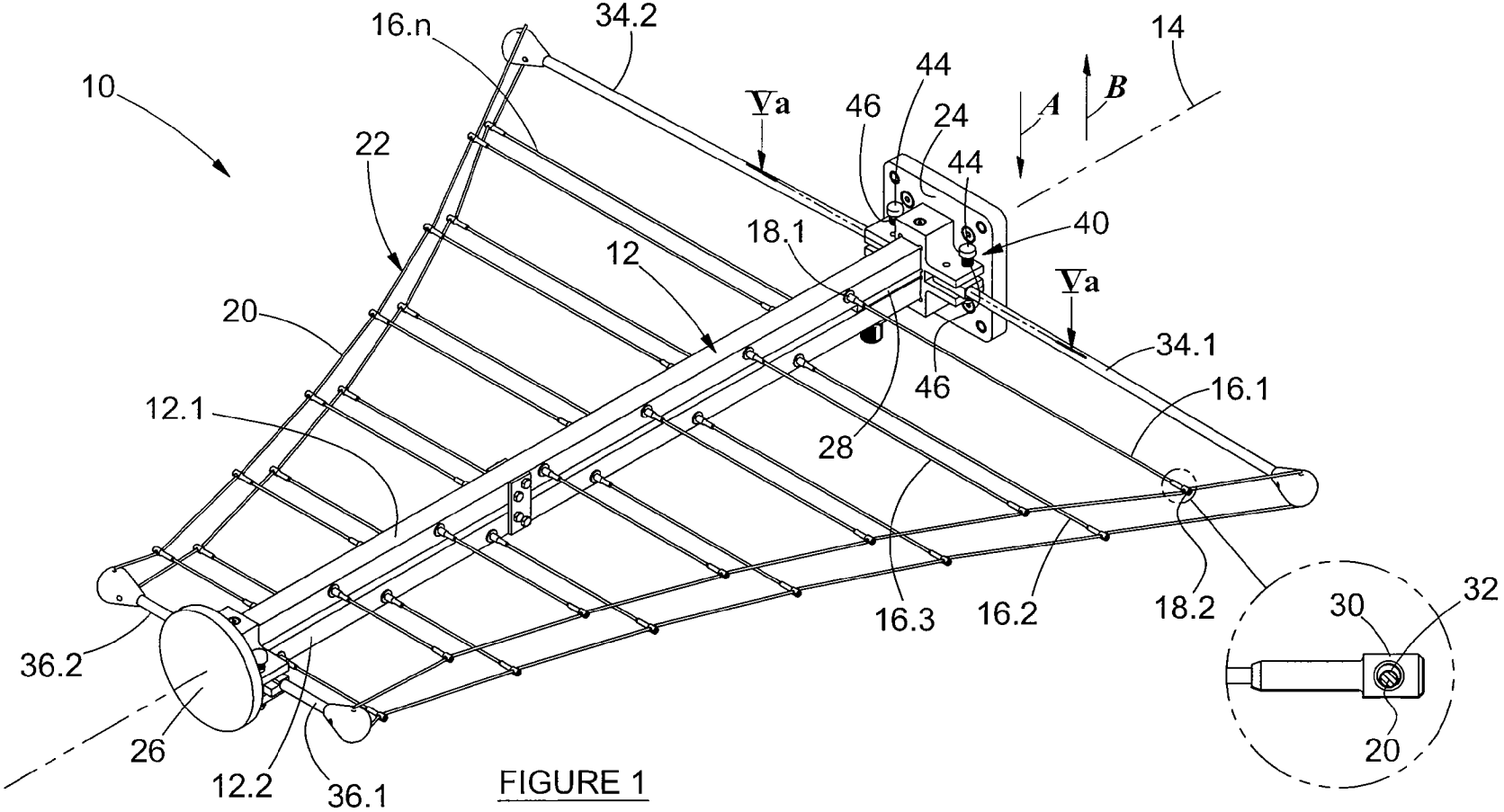
FIG. 1 is a diagrammatic isometric view of a first embodiment of the collapsible antenna according to the invention in an operative configuration thereof.
Figure 5A:
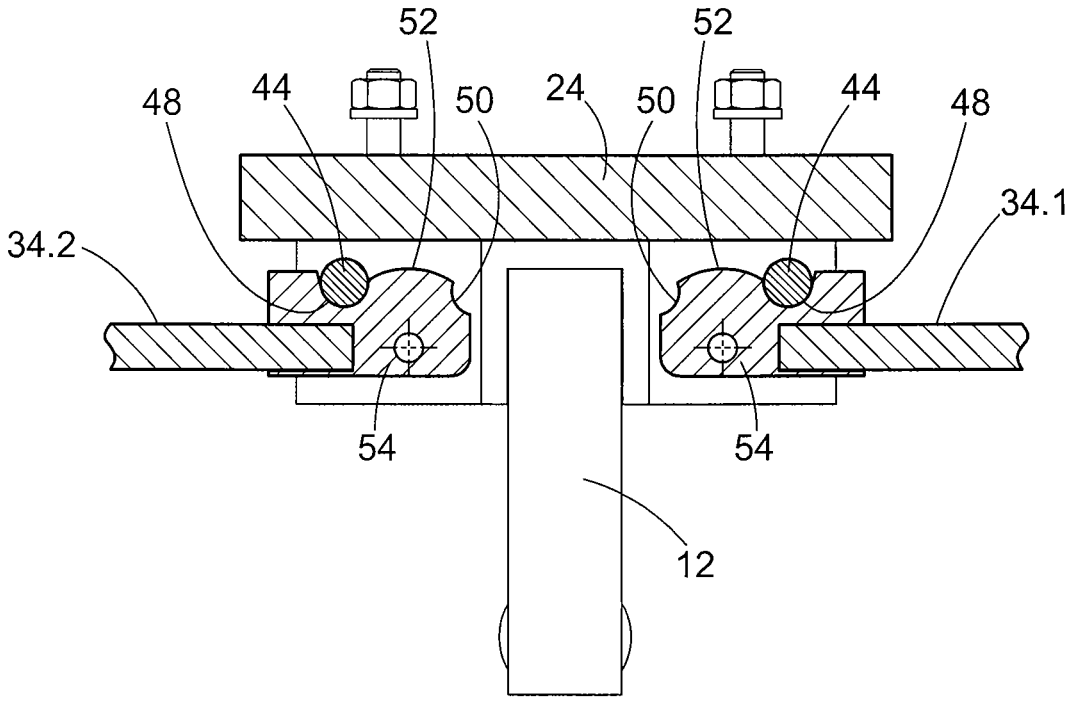
Figure 5B:
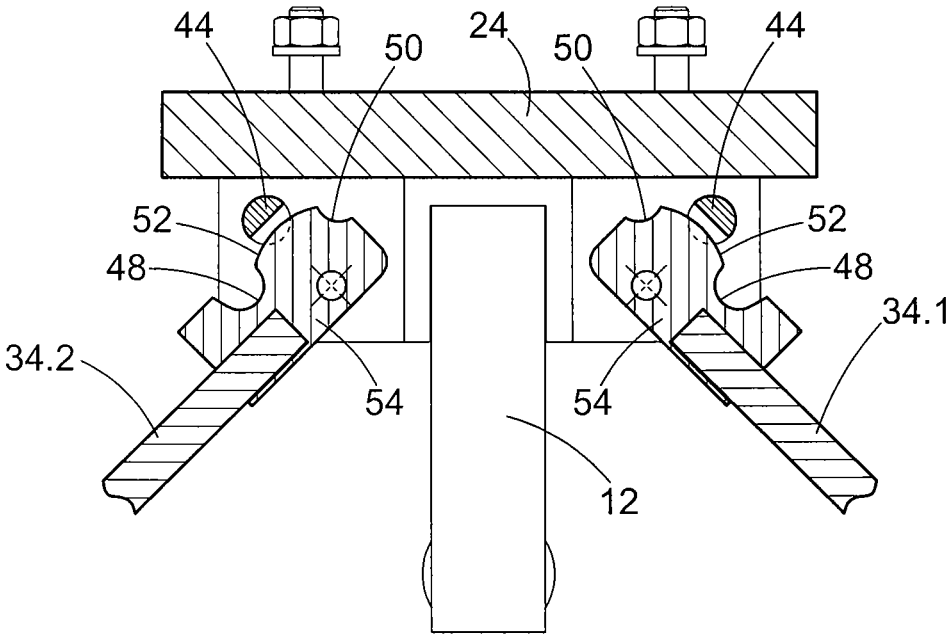
Figure 5C:
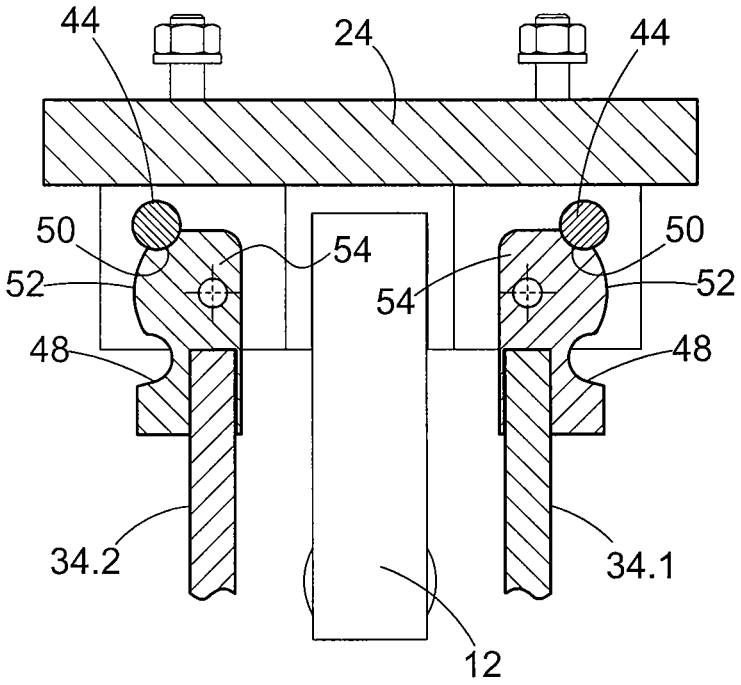
Figure 6:
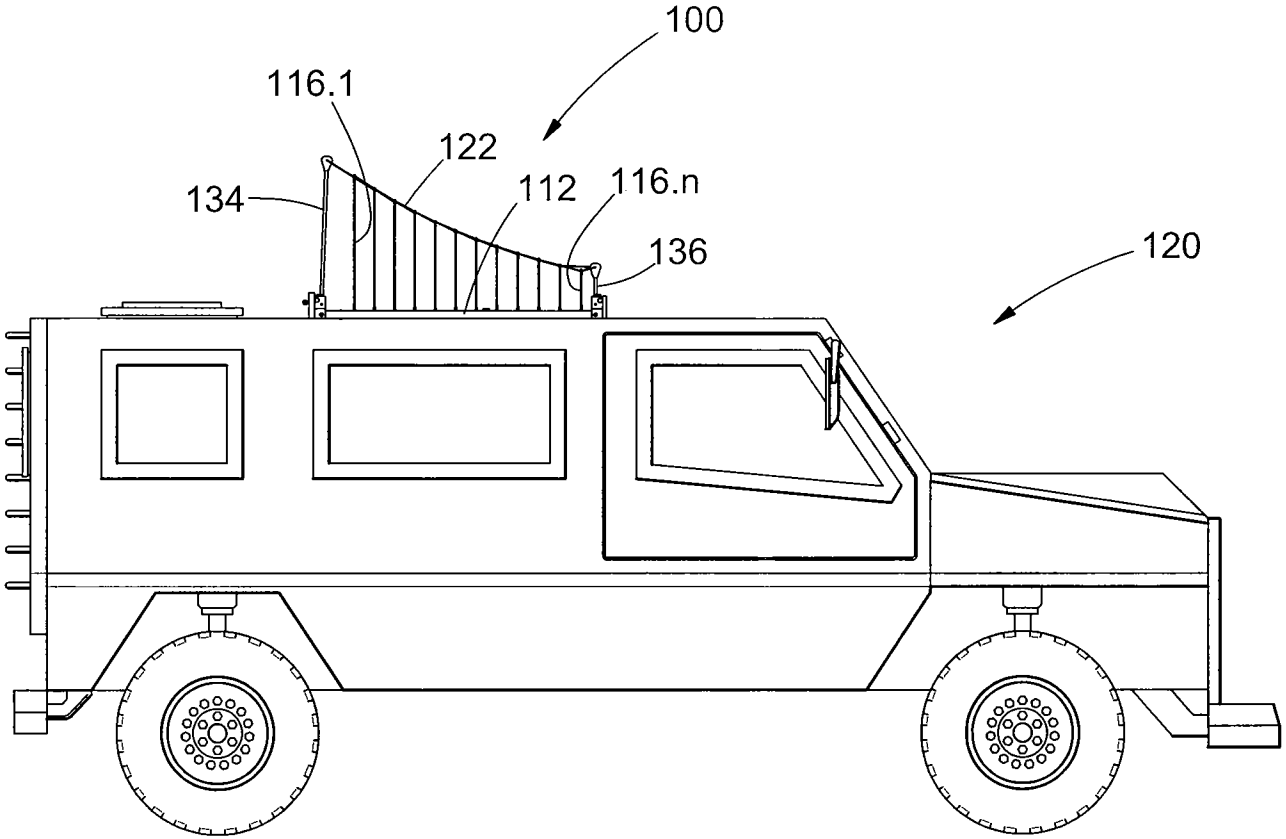

FIG. 5*a* is a section on line Va in FIG. 1;

FIG. 5*b* is a similar section with the antenna in the aforementioned partially collapsed configuration;

FIG. 5*c* is a similar section with the antenna in the fully collapsed configuration; and FIG. 6 is a diagrammatic side view of a second embodiment of the antenna mounted on a roof of a vehicle and in the operative configuration.

DESCRIPTION OF A PREFERRED EMBODIMENT OF THE INVENTION

A first embodiment of a collapsible antenna is generally designated by the reference numeral 10 in FIGS. 1 to 4.

The antenna 10 comprises an elongate boom 12 having a main axis 14 and a plurality of elongate electricity conductive radiating elements 16.1 to 16.n, each having a respective first end 18.1 and a respective second end 18.2. At least some of the elongate radiating elements are flexible and are mounted at their respective first ends 18.1 on the boom 12 in longitudinally spaced relation along the boom. Regions towards the respective second ends 18.2 of the at least some of the elongate radiating elements engage a rope 20, preferably are connected to the rope 20. Preferably, the rope is flexible and non-conductive. The non-conductive flexible rope 20 forms part of a frame 22, which is permanently mounted on the boom and collapsible relative to the boom 12 between a first collapsed configuration (shown in FIG. 4) and a second operative configuration (shown in FIGS. 1 and 2) wherein the at least some radiating elements 16.1 to 16.n are in an operative configuration relative to the boom 12.

The antenna in FIGS. 1 to 4 is a log periodic dipole array (LPDA). In this embodiment, the boom 12 comprises first and second parallel elongate conductive boom parts 12.1 and 12.2 mounted between a base 24 and a head 26 and spaced from one another by non-conductive spacers 28.

The first end 18.1 of each radiating element 16.1 to 16.n is permanently secured to the boom by a mounting member. The mounting member comprises a sleeve-like member having an external thread. The sleeve-like member is crimped onto the first end of the radiating element and the threaded region is screwed into a hole on the boom. Adjacent radiating elements are mounted alternatively on the first and the second boom parts 12.1 and 12.2.

The second end 18.2 of each radiating element 16.1 to 16.n carries a terminating element or ferrule 30 defining an eye 32. The rope 20 passes freely through the eye.

The collapsible frame 22 further comprises a pair of opposed rear frame members or arms 34.1 and 34.2 adjacent base 24 and a pair of front frame members or arms 36.1 and 36.2. The rear arms 34.1 and 34.2 are stiff, but somewhat resiliently flexible and the front arms may be more stiff. Proximate ends of the arms of each pair are pivotably mounted on the boom as will hereinafter be described in more detail. A rope 20 connected to the distal ends of the radiating elements extends on either side of the boom 12 between distal ends of the rear and front arms, thereby to form, collectively with the pairs of arms, a continuous frame 22 which is collapsible, as hereinafter described.

At least some of the rear and/or front arms may be conductive and constitute radiating elements. In other embodiments, at least some of these arms and even all of these arms are non-conductive and merely form part of the collapsible frame. In embodiments wherein these arms do not serve as radiating elements, they may be made of a glass reinforced plastic material.

Figure 3:
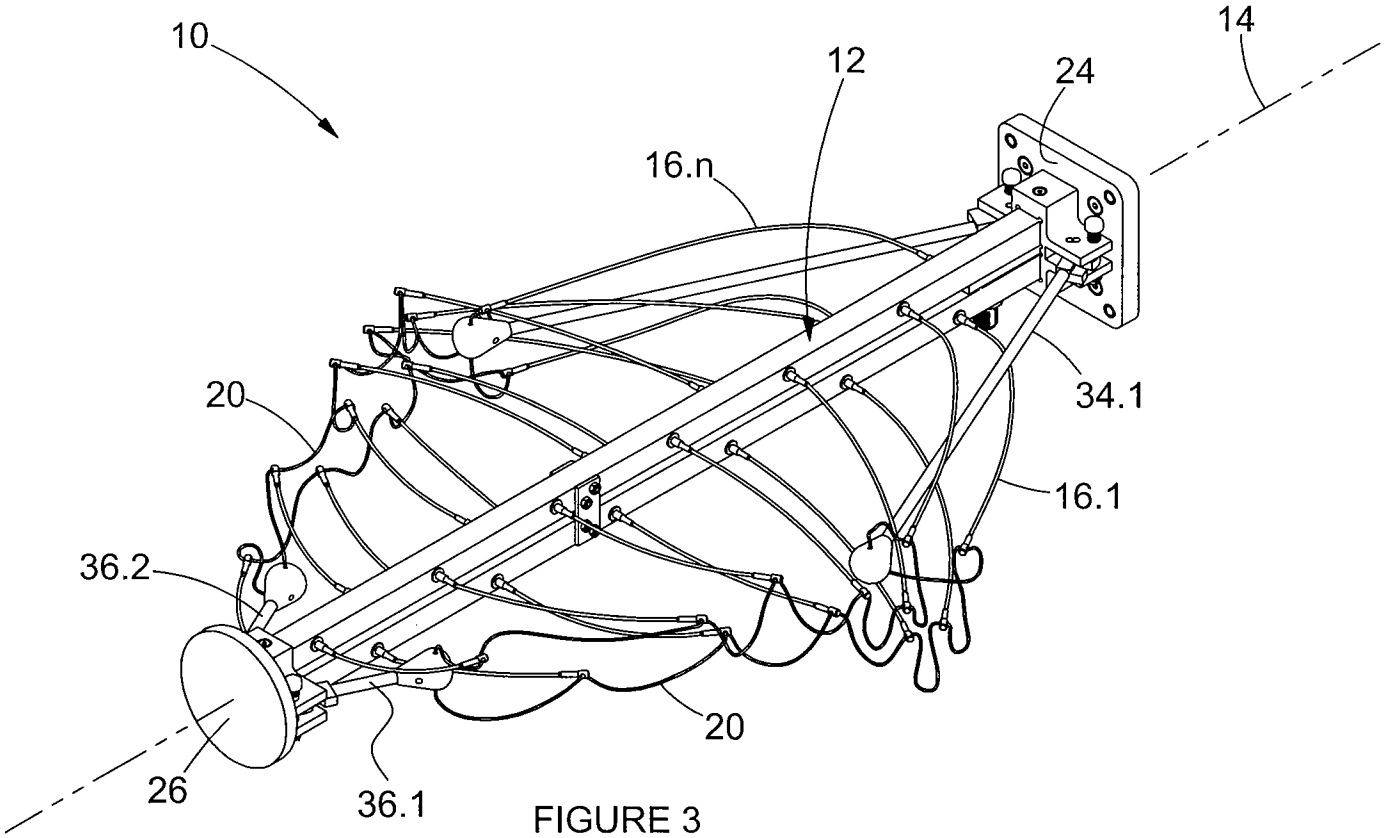
FIG. 3 is a view similar to that of FIG. 1 with the antenna in a partially collapsed configuration.
Figure 4:
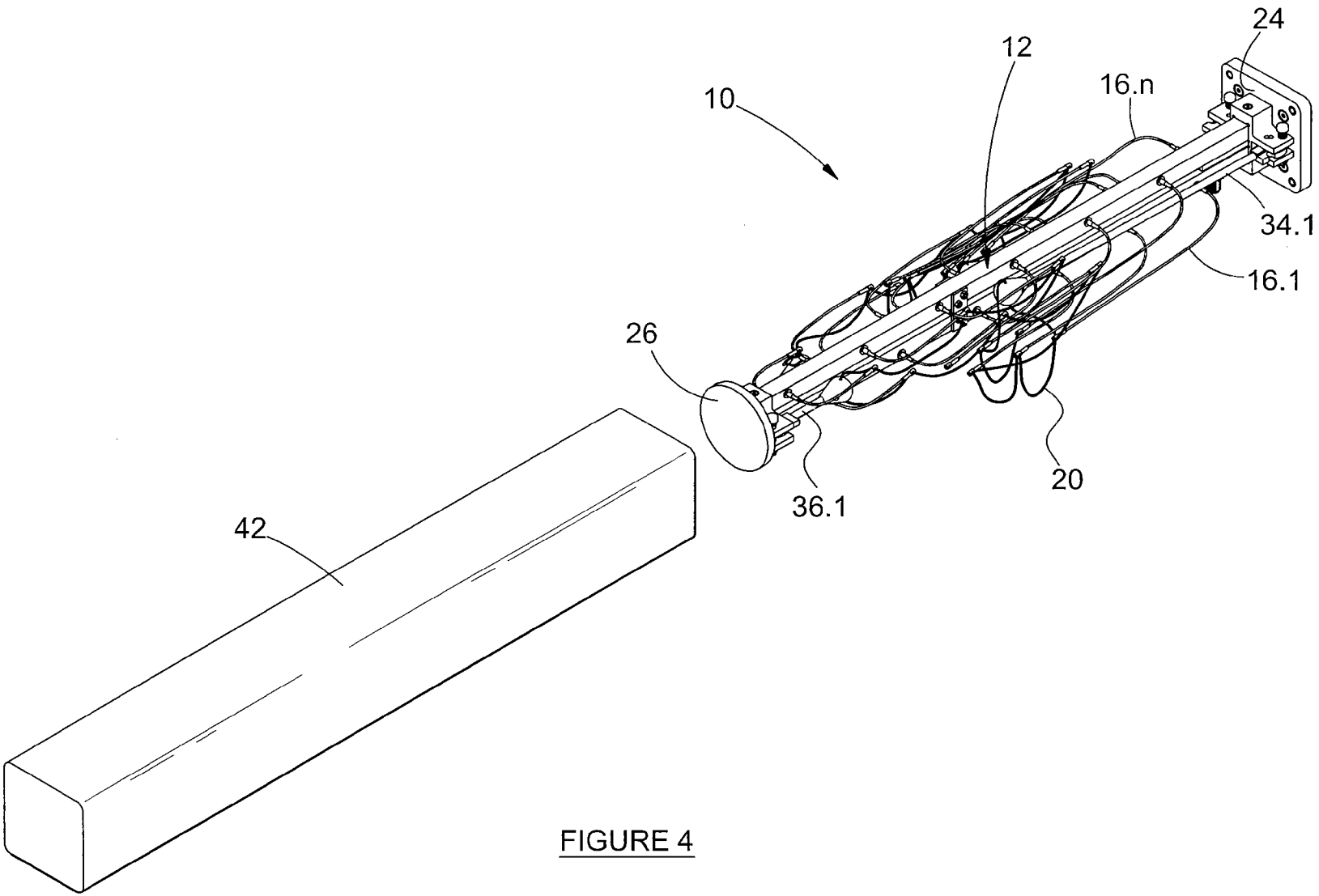
FIG. 4 is an exploded isometric view of the antenna in a fully collapsed configuration and a portable container therefor.

In some embodiments (such as the embodiment of FIGS. 1 to 4) all of the rear arms 34.1 and 34.2 and the front arms 36.1 and 36.2 are pivotable through about 90° relative to the boom between a first collapsed position wherein they are collapsed onto the boom (as shown in FIG. 4) and a second operative position (shown in FIGS. 1 and 2), wherein they extend perpendicularly relative to the boom. In some embodiments, only the rear arms 34.1 and 34.2 are so pivotable.

Figure 2:
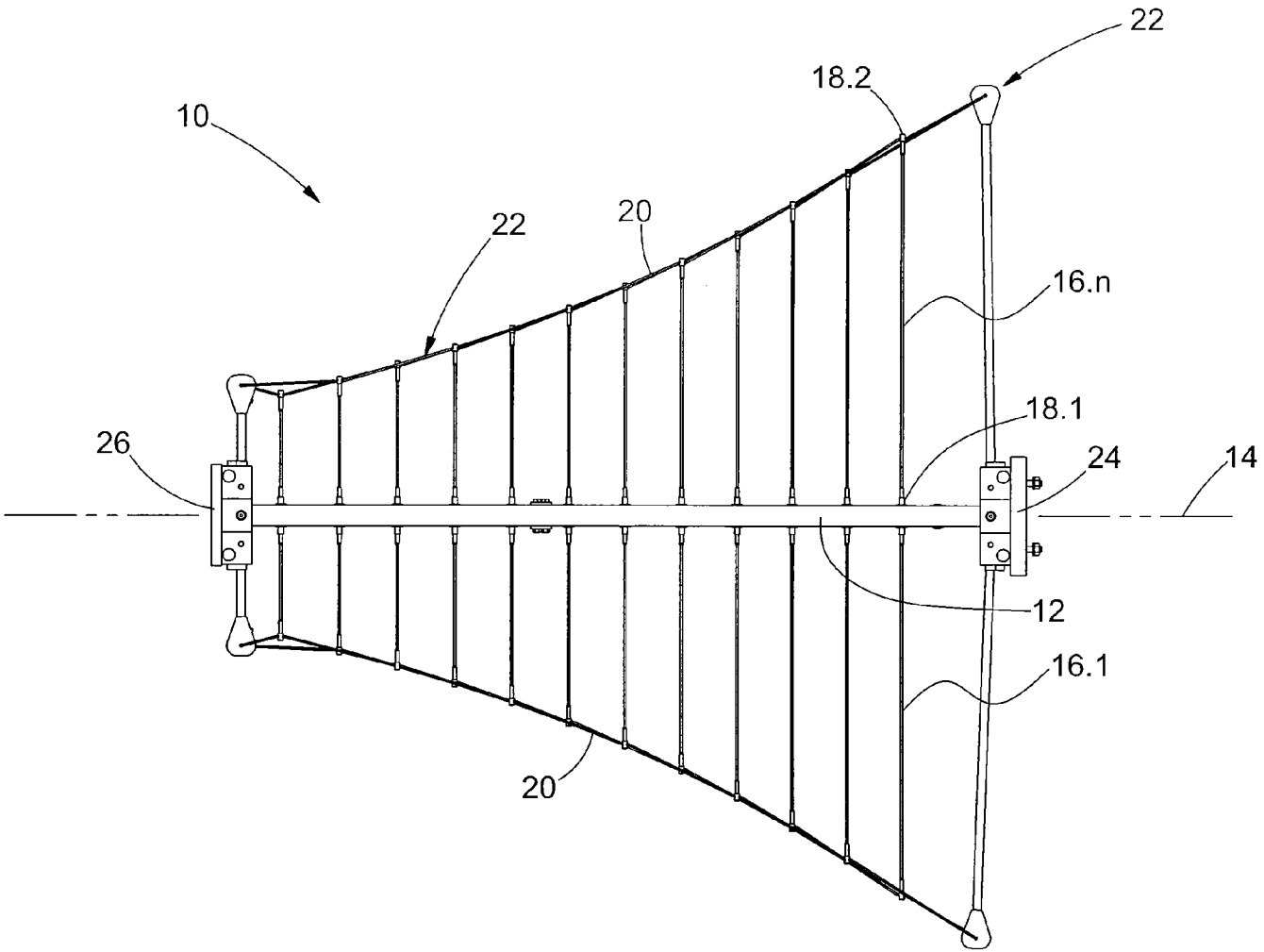
FIG. 2 is a diagrammatic plan view of the antenna in FIG. 1.

As shown in FIGS. 1 and 2, with the antenna 10 in the operative configuration, the rear and front arms are at about 90° relative to the boom, so that they extend outwards at right angles to the boom. With the arms in this position, the rope 20 on either side of the boom is pulled taught and extends the radiating elements, so that they are held taught roughly at right angles relative to the boom to form an operative antenna. When it is desired to collapse the antenna for storage or transport, locking mechanisms 40 (which will be described in more detail hereinafter) cooperating with the arms 34.1, 34.2, 36.1 and 36.2 are actuated and the arms 34.1, 34.2 and 36.1, 36.2 are collapsed onto the boom 12. This collapsing releases the tension in the ropes 20 and allows the radiating elements to become slack. The fully collapsed antenna shown in FIG. 4 may then be fitted into a portable container 42 therefor.

The aforementioned locking mechanism 40 is shown in more detail in FIGS. 5*a* to 5*c*. The mechanism 40 comprises a pin 44, which is biased by a spring 46 (shown in FIG. 1) and a profiled surface 52 towards or at the proximate end of the relevant arm adjacent the boom. The profiled surface 52 is preferably provided on an end piece 54 of the relevant arm. The pin cooperates with a first recess 48 or a second recess 50 in the profiled surface.

Referring to FIG. 1, normally, the pin 44 is biased in a direction A. In FIG. 5*a* the configuration of pin 44 and end piece 54 is shown when the antenna 10 is in the operative configuration of FIGS. 1 and 2 and wherein the pin engages the first recess 48 in the end piece 54. In order to collapse the frame 22 and hence antenna 10, the pin 44 is manually manipulated in a direction B directly opposite to the direction A. The relevant arms are manually collapsed onto the frame as shown in FIG. 3 (which corresponds to FIG. 5*b*) until the relevant arms reach the fully collapsed configuration as shown in FIG. 4 (which corresponds with FIG. 5*c*). The pin 44 is now released to cooperate with the second recess 50 and to lock the arms in the collapsed positions.

In some example embodiments, each radiating element may comprise a non-conductive extension at its second end and the non-conductive extension engages the rope, so that the radiating element indirectly engages the rope. The extension may be in the form of an elongate ferrule or any other suitable link, string, rope or the like.

In FIG. 6 there is shown another embodiment of the antenna designated 100. This antenna 100 is not symmetrical as the antenna 10 is, but comprises a boom 112 which is mountable substantially parallel with a mounting surface, such as a roof of a vehicle 120. Arms 134 and 136 are pivotable as hereinbefore described to manipulate the antenna between an operative configuration as shown in FIG. 6 wherein the rope 120 is taught and holds the radiating elements 116.1 to 116.n taught and at substantially right angles relative to the boom and a collapsed configuration (not shown) wherein the radiating elements are slack.

The invention claimed is:

1. A collapsible antenna comprising:

an elongate boom having a main axis;

a plurality of elongate radiating elements having respective first and second ends;

at least some of the elongate radiating elements being flexible and being mounted at the respective first ends to the boom in longitudinally spaced relation;

regions towards the respective second ends of the at least some of the elongate radiating elements directly or indirectly engaging a flexible rope; and the flexible rope forming part of a frame which is manipulatable relative to the boom between a first collapsed configuration and a second operative configuration wherein the at least some radiating elements are in an operative configuration relative to the boom.

2. An antenna as claimed in claim 1 wherein the rope is non-conductive.

3. An antenna as claimed in claim 1 wherein in the operative configuration, the at least some of the elongate radiating elements extend perpendicularly to the boom.

4. An antenna as claimed in claim 1 wherein the boom extends between a base and a head and wherein the frame comprises at least one pivotable arm adjacent the base.

5. An antenna as claimed in claim 4 wherein the frame comprises at least one arm adjacent the head.

6. An antenna as claimed in claim 5 wherein the at least one arm adjacent the head is either pivotable relative to the boom or removable therefrom.

7. An antenna as claimed in claim 4 wherein at least some of the arms are conductive and serve as a radiating element.

8. An antenna as claimed in claim 4 wherein at least some of the arms are made of an insulating material.

9. An antenna as claimed in claim 1 wherein each of the respective first ends of the at least some of the elongate radiating elements are permanently mounted on the boom by a mounting member.

10. An antenna as claimed in claim 9 wherein the mounting member comprises an externally threaded sleeve-like member which is crimped onto the respective first end and screwed into the boom.

11. An antenna as claimed in claim 1 wherein each of the at least some of the elongate radiating elements comprises towards the respective second end thereof a ferrule defining an eye, wherein the ferrule is made of an insulating material and wherein the rope extends through the eye.

12. An antenna as claimed in claim 1 wherein the boom is a centre boom and the radiating elements are mounted on either side of the boom.

13. An antenna as claimed in claim 1 wherein the antenna is a log periodic dipole antenna (LPDA).

14. An antenna as claimed in claim 1 wherein the antenna is asymmetrical in that the radiating elements are mounted on one side of the boom only.

15. A kit comprising a collapsible antenna as claimed in claim 1 and a portable container therefor.

* * * * *